US011722824B2

(12) United States Patent
Guo

(10) Patent No.: US 11,722,824 B2
(45) Date of Patent: Aug. 8, 2023

(54) SOUND PRODUCTION DEVICE AND ASSEMBLING METHOD THEREFOR

(71) Applicant: Goertek Inc., Shandong (CN)

(72) Inventor: Xiaodong Guo, Shandong (CN)

(73) Assignee: Goertek, Inc., Shandong (CN)

( * ) Notice: Subject to any disclaimer, the term of this patent is extended or adjusted under 35 U.S.C. 154(b) by 0 days.

(21) Appl. No.: 17/631,539

(22) PCT Filed: Dec. 24, 2019

(86) PCT No.: PCT/CN2019/127900
§ 371 (c)(1),
(2) Date: Jan. 31, 2022

(87) PCT Pub. No.: WO2021/036128
PCT Pub. Date: Mar. 4, 2021

(65) Prior Publication Data

US 2022/0286784 A1 Sep. 8, 2022

(30) Foreign Application Priority Data

Aug. 31, 2019 (CN) ..... 201910819931.7

(51) Int. Cl.

| | |
|---|---|
| ***H04R 9/06*** | (2006.01) |
| ***H04R 7/12*** | (2006.01) |
| ***H04R 7/16*** | (2006.01) |
| ***H04R 9/04*** | (2006.01) |
| ***H04R 31/00*** | (2006.01) |

(52) U.S. Cl.
CPC ..... *H04R 9/066* (2013.01); *H04R 7/127* (2013.01); *H04R 7/16* (2013.01); *H04R 9/045* (2013.01); *H04R 31/006* (2013.01)

(58) Field of Classification Search
CPC ..... H04R 9/066; H04R 7/127; H04R 7/16; H04R 9/045; H04R 31/006
See application file for complete search history.

(56) References Cited

U.S. PATENT DOCUMENTS

2017/0339478 A1* 11/2017 Xiao ..... H04R 1/06

FOREIGN PATENT DOCUMENTS

| | | |
|---|---|---|
| CN | 104185127 A | 12/2014 |
| CN | 205754835 U | 11/2016 |

OTHER PUBLICATIONS

International Search Report dated May 26, 2020 corresponding to International Patent Application No. PCT/CN2019/127900.

* cited by examiner

*Primary Examiner* — Sunita Joshi
(74) *Attorney, Agent, or Firm* — Baker Botts LLP

(57) ABSTRACT

Disclosed is a sound production device including a housing and a vibration assembly, the vibration assembly comprising a vibration diaphragm and a voice coil combined to one side of the vibration diaphragm; wherein the sound production device further comprises a system stabilization component connected with the voice coil; the system stabilization component is of a line-like structure formed by winding a metal wire, and comprises a first connection part connected to the voice coil, a deformation part, and a second connection part connected to the housing. By adopting the sound production device of this structure, the voice coil will not be polarized under the condition of large displacement, and the system stabilization component having a novel structure does not hinder the free vibration of the voice coil either.

16 Claims, 5 Drawing Sheets

SOUND PRODUCTION DEVICE AND ASSEMBLING METHOD THEREFOR

CROSS-REFERENCE TO RELATED APPLICATIONS

This application is a National Stage of International Application No. PCT/CN2019/127900, filed on Jul. 28, 2020, which claims priority to Chinese Patent Application No. 201910819931.7, filed on Aug. 31, 2019, both of which are hereby incorporated by reference in their entireties.

FIELD OF TECHNOLOGY

The present invention belongs to the electroacoustic field, in particular to a sound production device and an assembling method therefor.

BACKGROUND

Sound production device is an important acoustic component in electronic equipment, which is a transducer device that transforms electrical signals into acoustic signals. The existing sound production device includes a housing, a magnetic circuit system and a vibration assembly disposed in the housing.

A voice coil in the vibration assembly is prone to be polarized in a non-vibration direction during vibration. In order to prevent polarization, a system stabilization component connected with the voice coil is usually provided. The system stabilization component of the existing structure is an integrated sheet structure, and the system stabilization component of the sheet structure is combined to one end of the voice coil to prevent polarization.

Nevertheless, a system stabilization component of such a integrated sheet structure has resonance when vibrating, which will cause a THD local spike and the linear region is small, in the case of a large amplitude, since the system stabilization component cannot provide sufficient displacement, a pull in the opposite direction to voice coil displacement will occur, affecting the vibration of the voice coil. When amplitude of a miniature sound production device is greater than 0.6 mm, a traditional system stabilization component can no longer meet the requirements of large amplitude sound production device. Therefore, it is necessary to provide a novel system stabilization component to solve the problem of the voice coil polarization under large amplitude.

SUMMARY

The present invention provides a sound production device and an assembling method therefor, which can solve the polarization problem of the voice coil under large amplitude without hindering the free vibration of the voice coil.

The present invention provides a sound production device including a housing and a vibration assembly, the vibration assembly including a vibration diaphragm and a voice coil combined to one side of the vibration diaphragm; wherein the sound production device further includes a system stabilization component connected with the voice coil; the system stabilization component is of a line-like structure formed by winding a metal wire, and includes a first connection part connected to the voice coil, a deformation part, and a second connection part connected to the housing.

Preferably, the first connection part includes a first bonding zone and a third bonding zone; the first bonding zone is combined to the voice coil, a shape of the first bonding zone is the same as that of a portion of the voice coil to which the first bonding zone is combined; the third bonding zone protrudes from the first bonding zone and is electrically connected with a lead of the voice coil; and the first bonding zone and the third bonding zone are located on the same plane.

Preferably, the deformation part is formed by connecting a plurality of U-bend structures, with adjacent U-bends bending in opposite directions.

Preferably, the housing is provided with a pad, and the second connection part includes a first fixation part located at one end of the deformation part close to the housing; and the first fixation part is electrically connected with the pad.

Preferably, the second connection part further includes a second fixation part, the housing is provided with a location column, and the second fixation part is wound on the location column to combine the second fixation part with the location column as a whole; and the second fixation part is located at one end of the first fixation part far away from the deformation part.

Preferably, a top end of the location column is hot melted after the second fixation part is wound on the location column.

Preferably, the first connection part, the deformation part and the second connection part are all continuous structures formed by winding a metal wire; and the first connection part, the deformation part and the second connection part are located on the same plane.

Preferably, the voice coil is of a hollow columnar structure or a flat structure; the vibration diaphragm is combined to an end face of a top end or a bottom end of the hollow columnar voice coil or to a relatively narrow end face of the flat voice coil; the first connection part is connected to an end of the voice coil close to the vibration diaphragm; or, the first connection part is connected to an end of the voice coil far away from the vibration diaphragm; or, the first connection part is connected to an intermediate position of the voice coil.

Preferably, the system stabilization component is combined to one end of the voice coil close to the vibration diaphragm, and the vibration diaphragm, the system stabilization component and the voice coil are bonded and fixed into a whole; and the first connection part further includes a second bonding zone protruding from the first bonding zone, all or part of the second bonding zone being combined to the vibration diaphragm and the voice coil.

Preferably, the system stabilization component is made of a non-magnetic material such as phosphor bronze or beryllium copper.

Preferably, the sound production device is a miniature sound production device, the system stabilization component is wound from a wire with a circular cross section, and a wire diameter of the system stabilization component is within a numerical range of 0.08 mm to 0.15 mm.

Preferably, the sound production device is a large sound production device, the system stabilization component is wound from a wire with a circular cross section, and a wire diameter of the system stabilization component is within a numerical range of 0.2 mm to 0.5 mm.

The present invention further provides an assembling method of the sound production device, wherein the sound production device includes the above-mentioned system stabilization component, the vibration assembly and the housing, and the method includes the following steps: lifting the system stabilization component 3 by a jig, after the system stabilization component 3 and the housing 4 are fixedly connected, removing the jig to place a voice coil on the system stabilization component at a position corresponding to the first connection part.

Preferably, the assembling method further includes a step of applying glue to the vibration diaphragm including a bonding part for bonding with the voice coil, the step including applying glue to the bonding part of the vibration diaphragm and then bonding and fixing the vibration diaphragm, the system stabilization component and voice coil into a whole.

Preferably, the jig lifts the housing and the system stabilization component simultaneously so that the system stabilization component is fixedly connected with the housing.

Preferably, the jig includes a boss including a top surface and a side surface located at a periphery of the top surface and a pallet located at a lower end of the side surface, wherein the top surface, the side surface and the pallet form a step; the system stabilization component is lifted by the pallet and disposed around the side surface of the boss; and a width of the pallet is greater than or equal to a width of the second bonding zone. By adopting the sound production device of this structure, the voice coil will not be polarized under the condition of large displacement, and the system stabilization component having a novel structure does not hinder the free vibration of the voice coil either. The electronic equipment using this sound production device has good bass effect and good acoustic performance.

By adopting the sound production device of this structure, the voice coil will not be polarized under the condition of large displacement, and the system stabilization component having such a novel structure does not hinder the free vibration of the voice coil.

Other features and advantages of the present invention will become apparent from the following detailed description of exemplary embodiments of the present invention with reference to the appended drawings.

BRIEF DESCRIPTION OF THE DRAWINGS

The accompanying drawings which are incorporated in and constitute a part of the description illustrate embodiments of the present invention and together with the description thereof serve to explain the principles of the embodiments of the present invention.

DETAILED DESCRIPTION OF THE EMBODIMENTS

Figure 1:
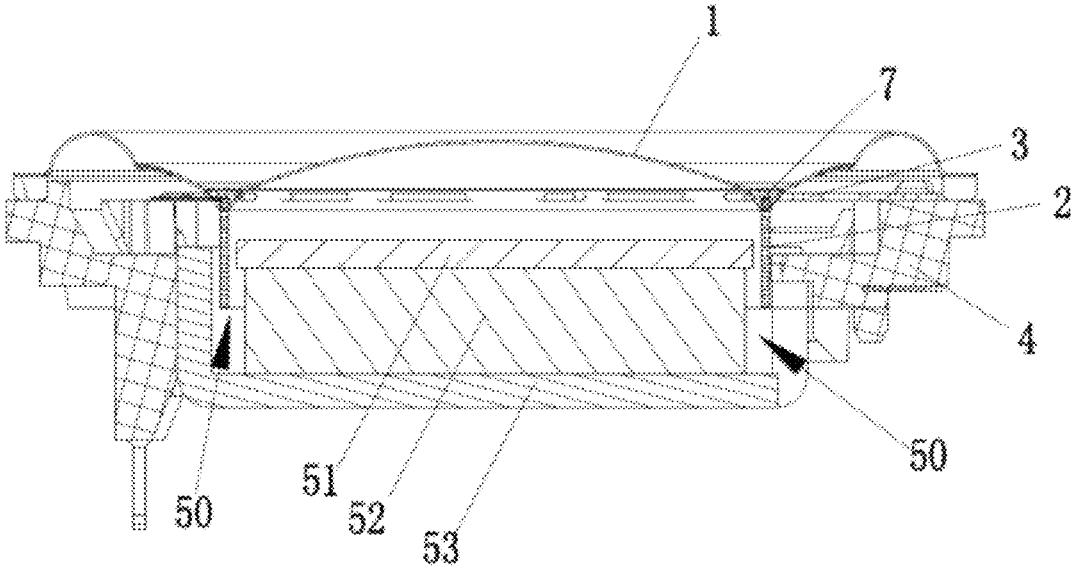
FIG. 1 is a cross-sectional view of a sound production device provided by the present invention.

Various exemplary embodiments of the present invention will be described in detail with reference to the accompanying drawings. It should be noted that unless otherwise specified, the relative arrangement, numerical expressions and values of components and steps set forth in these embodiments do not limit the scope of the present invention.

The following description of at least one exemplary embodiment is in fact merely illustrative and is in no way intended to limit the present invention and its application or use.

Techniques, methods and devices known to those ordinarily skilled in the relevant art may not be discussed in detail, but where appropriate, the techniques, methods and devices should be regarded as part of the authorized description.

In all the examples shown and discussed herein, any specific value should be interpreted as exemplary only and not as a limitation. Thus, other examples of the exemplary embodiment can have different values.

It should be noted that similar reference numerals and letters denote similar items in the following figures, and therefore, once a certain item is defined in one figure, it is not necessary to further discuss it in the following figures.

Figure 2:
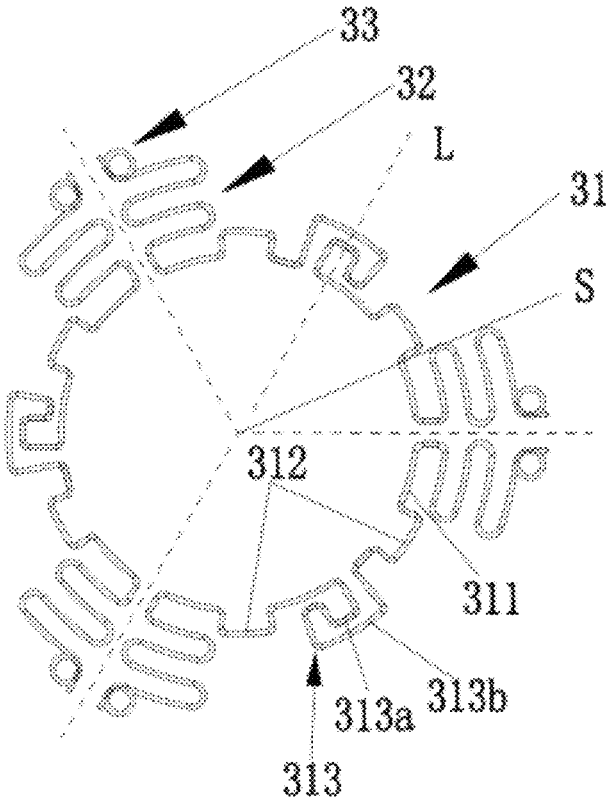
FIG. 2 is a top view of a system stabilization component of the sound production device provided by the present invention.
Figure 3:
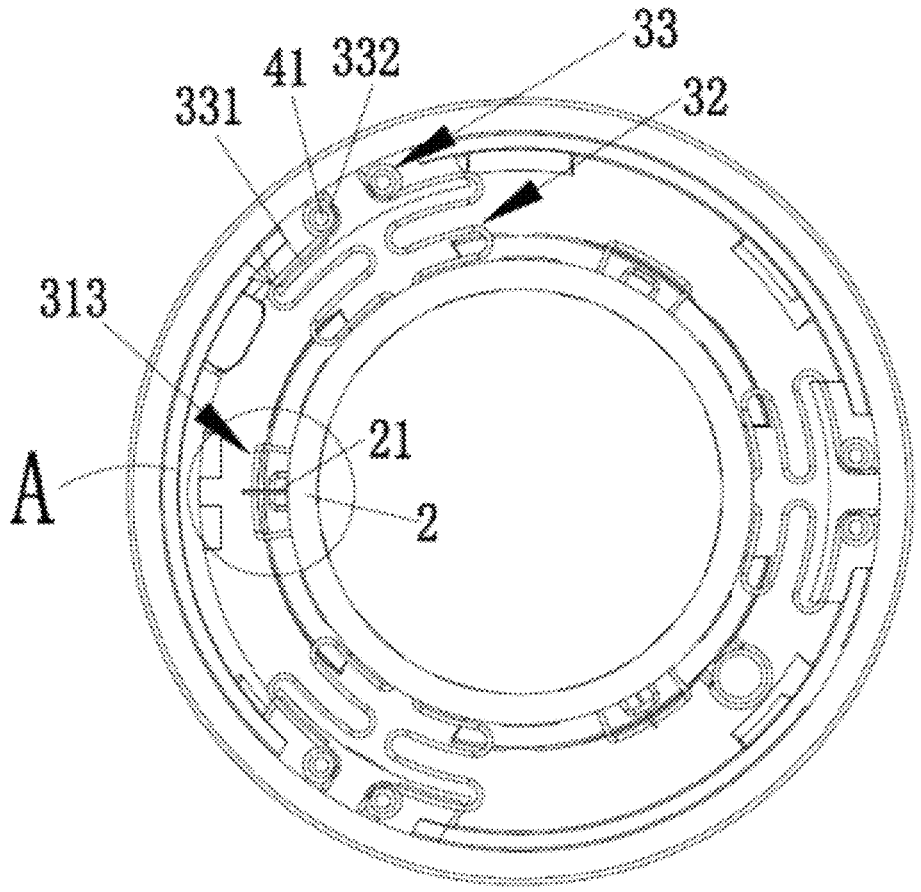
FIG. 3 is a bottom view of the sound production device provided by the present invention with a magnetic circuit assembly removed.

The present invention provides a sound production device. The sound production device has a novel system stabilization component, as shown in FIGS. 1 to 3, the sound production device includes a vibration assembly, a magnetic circuit assembly, and a housing 4 for mounting and fixing the vibration assembly and the magnetic circuit assembly; wherein the vibration assembly includes a vibration diaphragm 1 and voice coil 2 combined below the vibration diaphragm 1; The magnetic circuit assembly includes an upper magnetic conductive plate 51, a magnet 52 and a lower magnetic conductive plate 53, wherein the upper magnetic conductive plate 51 and the lower magnetic conductive plate 53 are magnetic conductive structures for correcting magnetic lines generated by the magnet 52. The magnetic circuit assembly forms a magnetic gap 50, and the voice coil 2 is disposed in the magnetic gap 50 of the magnetic circuit system. The lower magnetic conductive plate 53 has a U-shaped structure and includes a bottom wall and a side wall. The magnetic gap 50 is formed between the upper magnetic conductive plate 51, the magnet 52 and the side wall of the lower magnetic conductive plate 53. A relatively uniform magnetic field is formed in the magnetic gap 50, and the voice coil 2 is disposed in the magnetic gap 50 having the relatively uniform magnetic field. The voice coil 2 is usually formed by winding a metal wire. When the voice coil 2 turns on the electrical signal, it vibrates up and down under the action of ampere force in the magnetic field, in which "up" and "down" are subject to the direction shown in FIG. 1, a vibration direction of the voice coil 2 is indicated by a vertical direction or up-and-down direction, and the direction perpendicular to the vibration of the voice coil is indicated by a horizontal direction. Because the vibration diaphragm 1 and the voice coil 2 are fixed and combined into a whole by bonding, the voice coil 2 will also drive the vibration diaphragm 1 to vibrate and generate sound waves when it vibrates up and down according to the electrical signal.

However, since the magnetic field in the magnetic gap 50 is only relatively uniform and not absolute, the position of the voice coil 2 will also change during the vibration of the voice coil 2, and the magnetic lines of force located on an upper side of the magnetic gap 50 are curved lines. Therefore, an ampere force on the voice coil 2 is not only in the vertical direction, but also in other directions, which causes the polarization of the voice coil 2 in the non-vertical direction, and further affects the vibration of the vibration diaphragm 1.

In order to prevent the polarization of the above situation, the present invention provides a system stabilization component 3, and the system stabilization component 3 combined with the voice coil 2 can prevent movement of the voice coil 2 in the horizontal direction, and the system stabilization component can follow the voice coil 2 to move in the vertical direction.

The system stabilization component 3 has the characteristics of being easily deformed in the vertical direction and not easily deformed in the horizontal direction. Ideally, resistance of the system stabilization component 3 to the voice coil 2 in the vertical direction (the vibration direction of the voice coil) is 0, and the resistance to the voice coil 2 in the horizontal direction is infinite (polarization prevention). At present, the sound production device has higher and higher demands on bass, the corresponding voice coil 2 will have a larger vibration displacement. For the sound production device with a large displacement, taking miniature speakers as example, in the case where the maximum displacement of the voice coil 2 is greater than or equal to 0.6 mm, due to the limitation of space and its own structure, the existing system stabilization component cannot provide sufficient displacement in the vertical direction, which will form a pull on the voice coil and thus a relatively large resistance to the voice coil, alternatively, it cannot provide enough resistance in the horizontal direction, and cannot achieve the effect of preventing polarization. Therefore, there is a need to provide a better system stabilization assembly for application in the sound production device with large displacement, and the sound production device is certainly not limited to the miniature sound production device.

The present invention provides a system stabilization component 3, the system stabilization component 3 is of a line-like structure, is formed by winding a metal wire, certainly, is not limited to metal wire, winding with the metal wire is to facilitate the electrical connection of the lead 21 of the voice coil 2 with an external circuit. The system stabilization component 3 of the line-like structure is easy to bend into the desired shape, and it is beneficial to bend in a limited space to form a structure with large deformation displacement. Specifically, the system stabilization component 3 of the present invention has a first connection part 31 connected to the voice coil 2, a second connection part 33 connected to the housing, and a deformation part 32 for bridging the first connection part 31 and the second connection part 33. The voice coil 2 of this embodiment is of a hollow columnar structure, and a cross section of the voice coil 2 may be circular, rectangular or runway type. For example, the illustrated structure is circular, in which the first connection part 31 may be combined to one end of the voice coil 2 close to the vibration diaphragm 1 or far away from vibration diaphragm 1. In addition, the system stabilization component 3 can also be disposed at an end near the vibration diaphragm 1 and an end far away from the vibration diaphragm 1, that is, the system stabilization components 3 are set in two groups, which are respectively disposed corresponding to two end faces of the voice coil 2. This structure has better anti-polarization effect, but the housing 4 and/or the magnetic circuit assembly need to provide certain avoidance. Of course, it can also be combined to the side wall of the hollow columnar voice coil 2. The voice coil 2 can only include a voice coil wire portion (the voice coil wire is wound to form a hollow columnar structure), or it may include a voice coil bobbin and a voice coil wire, the voice coil wire is wound on voice coil bobbin, or the voice coil wire is wound to form a hollow columnar structure and assembled to the voice coil bobbin. The system stabilization component 3 can be combined to the side wall of the voice coil corresponding to a voice coil wire area, and can also be combined to the voice coil bobbin.

It should be noted that this line-like structure system stabilization component is also applicable to the voice coil with the flat structure, and the large deformation displacement that can be realized by line-like structure system stabilization component is also applicable to the flat voice coil with large amplitude. The structure and working principle of the flat voice coil are shown in CN202178863U. The flat voice coil includes upper and lower surfaces with large areas, and the smaller and relatively narrow end faces located on the side. The vibration diaphragm is combined to the relatively narrow end face of flat voice coil (one of the end faces), the system stabilization component is also combined to the relatively narrow end face of the voice coil, and the system stabilization component can be combined to the end of the voice coil near vibration diaphragm or the end of the voice coil far away from vibration diaphragm. The system stabilization component can be set at the end of the voice coil near the vibration diaphragm or far away from the vibration diaphragm, or at the middle of the flat voice coil. When applied to the flat voice coil, the specific structure of the system stabilization component may change, but it does not affect the anti-polarization effect of the line-like system stabilization component at large amplitude.

As shown in FIGS. 2 and 3, the first connection part 31 of the system stabilization component 3 includes a first bonding zone 311 extending in the same direction as an end portion of the voice coil 2, and a second bonding zone 312 and a third bonding zone 313 extending to inside or outside of the first bonding zone 311 in a protruding manner. The first bonding zone 311, the second bonding zone 312 and the third bonding zone 313 are disposed on the same plane.

The first bonding zone 311 is directly combined to the end portion of the voice coil 2 by bonding or the like, and a shape of the first bonding zone 311 is identical to that of the end portion of the voice coil 2 to which the first bonding zone 311 is bonded. As shown in FIG. 2, the voice coil 2 of this embodiment has a hollow cylindrical structure, so the first bonding zone 311 has an arc-shaped structure. The second bonding zone 312 protrudes to the outside of the first bonding zone 311 (at a position far away from a center of the voice coil 2) or to the inside of the first bonding zone 311 (at a position near the center of the voice coil 2), that is, a wire diameter in the second bonding zone 312 is extending to a position far away from or near the center of the voice coil 2 and then returning to the position of the first bonding zone 311. In this embodiment, the first bonding zone 311 and the second bonding zone 312 have a continuous line-like structure, but certainly they may also have a discontinuous structure. One or more second bonding zones 312 may be provided on each system stabilization component 3, with all or part of the second bonding zones 312 bonded to the voice coil 2 by bonding or the like. By providing a raised second bonding zone 312, a length of the first connection part 31 can be increased, and a bonding area of the first connection part 31 and the voice coil 2 can be increased, which is beneficial to the firm bonding of the system stabilization component 3 and the voice coil 2. As a matter of course, it is not limited to this form, the first connection part 31 may also be provided with only a first bonding zone, an extending direction of the first bonding zone is consistent with the shape of the end portion of the voice coil. Alternatively, the first connection part 31 is provided with only a second bonding zone, and the second bonding zone extends in a curved shape. This structure with only the second bonding zone and the second bonding zone extending in a curved shape can also increase the bonding area and a bonding strength of the system stabilization component 3 and the voice coil 2.

Figure 4:
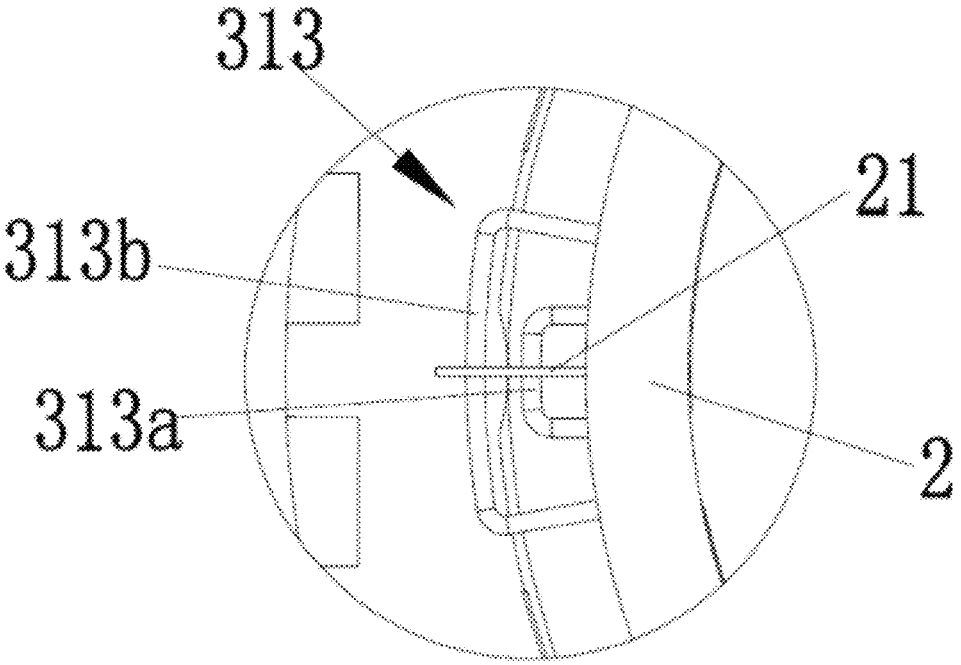
FIG. 4 is an enlarged partial schematic view of a part A of the sound production device shown in FIG. 3.

The third bonding zone 313 is likewise convex in an inward or outward direction. As shown in FIGS. 2 and 4 together, part of the structure of the third bonding zone 313 is fixedly bonded with the end portion of the voice coil 2 by bonding, etc., and part of the structure of the third bonding zone 313 is fixedly bonded with the voice coil 2, which can also increase the bonding zone and strength of the voice coil 2 and the system stabilization component 3. The third bonding zone 313 of the present embodiment can be used to electrically connect with the lead 21 of the voice coil 2 to achieve the electrical connection between the voice coil 2 and an external circuit. The voice coil 2 of this embodiment is formed by winding voice coil wires. The voice coil wire includes a conductive core located inside and a non-conductive insulating material located outside. The insulating material can avoid short circuits when the voice coil wires are in contact. The leads of the voice coil with a traditional structure are electrically connected with the pad by welding or applying a conductive adhesive. Because of a large area of the pad, the solder or conductive adhesive will contact the core on an end face of the lead in the process of welding or applying conductive adhesive, thus the electrical connection between the lead and the pad can be achieved. Since the system stabilization component 3 in the present application is of a line-like structure, when the lead 21 is electrically connected with the system stabilization component 3, it is line-to-line contact, and the contact point is very small. Therefore, before the lead 21 is electrically connected with the system stabilization component 3, the insulating material of the lead 21 located in the contact point area is removed, and the area where the insulating material is removed needs to cover the contact points to realize the electrical connection between the voice coil 21 and the system stabilization component 3. In this embodiment, the non-conductive insulating material on the outside of the lead 21 is an insulating paint. In the present application, the insulating paint is removed by laser hot melt, so that the conductive wire core at the position corresponding to the contact point of the lead 21 is exposed, so as to facilitate the combination with the system stabilization component 3.

Specifically, a route of the wire for the third bonding zone 313 is extending to the outside or the inside of the first bonding zone 311 in a protruding manner, then turning around to extend along a similar route to the first bonding zone 311 and connecting with the first bonding zone. In this embodiment, the first bonding zone 311 and the third bonding zone 313 are of a continuous structure, and of course, the third bonding zone 313 may be independent of the first bonding zone 311. In the present embodiment, the third bonding zone 313 is provided with two radially extending arcs corresponding to the position along the lead 21. The first connecting wire 313*a* near the voice coil 2 and the second connecting wire 313*b* far away from the voice coil 2 are both radially extending and have a circular arc-shaped structure. The lead 21 extends from the end portion of the voice coil 2 to the position of the second connecting wire 313*b*, intersects the first connecting wire 313*a* and the second connecting wire 313*b* simultaneously, and is electrically connected to the first connecting wire 313*a* and the second connecting wire 313*b* at the position of two intersection points at the same time, specifically by welding or applying a conductive adhesive.

Since the lead 21 is electrically connected to the line-like system stabilization component 3 only at the intersection point, there may be a risk of weak bonding, and this embodiment reduces this risk by setting two intersections. If one of the connection points (i.e., the position of the intersection point) is disconnected, the other connection point can still be electrically connected normally, ensuring that the lead 21 is electrically connected with the external circuit. The lead 21 of the voice coil 2 is led out from one end of the system stabilization component 3 and electrically connected with the system stabilization component 3. Because the voice coil 2 and the system stabilization component 3 vibrate synchronously during the vibration of the voice coil 2, the risk of the lead 21 falling off the system stabilization component 3 is reduced.

In the present application, the system stabilization component 3 is combined to the end of the voice coil 2 near the vibration diaphragm 1, that is, the system stabilization component 3 is bonded between the vibration diaphragm 1 and the voice coil 2, and the vibration diaphragm 1, the system stabilization component 3 and voice coil 2 in this embodiment are fixedly combined together by bonding. Part or all of the second bonding zone 312 of the system stabilization component 3 is bonded and fixed with the vibration diaphragm 1, which can increase the bonding area between the system stabilization component 3 and the vibration diaphragm 1 and facilitate the firm bonding between the system stabilization component 3 and the vibration diaphragm 1. Similarly, if part or all of the third bonding zone 313 is bonded and fixed to the vibration diaphragm 1, the bonding area and the bonding strength of the third bonding zone 313 and the vibration diaphragm 1 can be increased. In this embodiment, the first bonding zone 311, the second bonding zone 312 and the third bonding zone 313 are located on the same plane, a planar structure is advantageous to the combination to the end portions of the voice coil 2, and because of the planar structure of the region where the vibration diaphragm 1 and the system stabilization component 3 are combined, the first connection part 31 is disposed in a planar structure which is also advantageous to the fixed combination with the vibration diaphragm 1.

The first connection part 31 can also be combined to the end of the voice coil 2 far away from the vibration diaphragm 1, all of the structure of the first bonding zone 311, part or all of the structure of the second bonding zone, and part of the structure of the third bonding zone 313 are bound to the end of the voice coil 2 far away from the vibration diaphragm 1. The lead 21 of the voice coil 2 extends from the end face of the bonding end and is electrically connected to the third bonding zone 313. The first bonding zone 311 and the second bonding zone 312 may be modified or only one of them may be retained. Similarly, the first connection part 31 may be combined to the side wall of the hollow columnar voice coil 2, in which case, the inner side of the first bonding zone 311 is fixed to the outer side wall of the voice coil 2 by clamping, and then fixed again by bonding or the like, so that the two are firmly bonded, or a fixing member connecting the voice coil 2 and the system stabilization component 3 may be separately provided to bond the two. The first bonding zone 311 and the second bonding zone 312 may be modified without affecting the implementation of the present embodiment. All the above improvements can achieve the technical effect of preventing the polarization of the voice coil. At this time, the magnetic circuit system or the structure of housing 4 may need to be adjusted accordingly, but the anti-polarization effect of the line-like system stabilization component 3 will not be affected.

For the voice coil 2 with a voice coil bobbin, the first connection part 31 can be combined with the bobbin, the voice coil wire portion, or both. For example, when the system stabilization component 3 is combined to the one side of the voice coil near the vibration diaphragm 1, the first connection part 3 can only be combined with the voice coil bobbin, and combined to an end of the voice coil bobbin near the vibration diaphragm 1. When the system stabilization component 3 is combined to the side of the voice coil 2 far away from the vibration diaphragm 1, the first connection part 31 can be combined with both the voice coil bobbin and the voice coil wire portion. When the system stabilization component 3 is combined to the side wall of the voice coil 2, the first connection part 31 can be combined to the side wall of the voice coil bobbin, or combined to the side wall of the voice coil wire. Among the above-mentioned changes in the combination manner, some minor structural changes in the first connection part 31 are also within the scope of the present invention.

The deformation part 32 can have relatively large deformation displacement in the vertical direction (i.e., a vibration direction of the voice coil 2), while the deformation displacement in the horizontal direction is relatively small. The deformation part 32 is formed by connecting a plurality of U-bend structures, wherein a U-bend includes a curved bottom and side parts on both sides. The bottom is circular and the side parts are two line segments. For the voice coil of a circular structure, it is preferred that the side part is a radially extending arc with a non-straight line, and preferably, a center of circle corresponding to the arc is the same as that of the voice coil. The adjacent U-bends bend in opposite directions so that the deformation part 32 of this structure is difficult to move in both the radial direction and the horizontal direction, and is prone to deformation in the vertical direction. The deformation part 32 of the present application has 4 U-bends, but the number is not limited to 4, and can also be more or less than 4, which should be determined according to the actual situation of the product. A plurality of U-bends of the deformation part 32 are all disposed on the same plane, that is, on the plane perpendicular to the vibration direction of the voice coil 2. Setting on the same plane can increase the difficulty of deformation in the horizontal direction and achieve better anti-polarization effect. The U-bend of this embodiment has different widths in the radial direction, with the U-bend near one side of the second connection part 33 having a relatively larger radial width. In particular, the width of the U-bend of deformation part 32 gradually decreases along the side near housing 4 to the side near the voice coil 2, the larger the radial width is, the more favorable it is for deformation to occur. In the present application, the U-bend with a large radial width is provided on the side near the second connection part 33, which is beneficial to reduce the deformation resistance of the deformation part 32 on the side near housing 4, thus facilitating the reduction of the resistance of the deformation part 32 to the voice coil 2. Preferably, apexes of the bottoms of the U-bends at the same side are located on the same axis S, as shown in FIG. 2, which of course allows some error, and the bottoms of the U-bends arc located on the same axis to further reduce the resistance of deformation of the deformation part 32. In order to ensure that the deformation part 32 has sufficient deformation displacement in the vibration direction of the voice coil 2 and that there is no interference between radially extending arcs of the U-bends, spacing between radially extending arcs disposed adjacent to the deformation part 32 of this embodiment is greater than or equal to 3d, where d is a diameter of the line-like system stabilization component.

Figure 5:
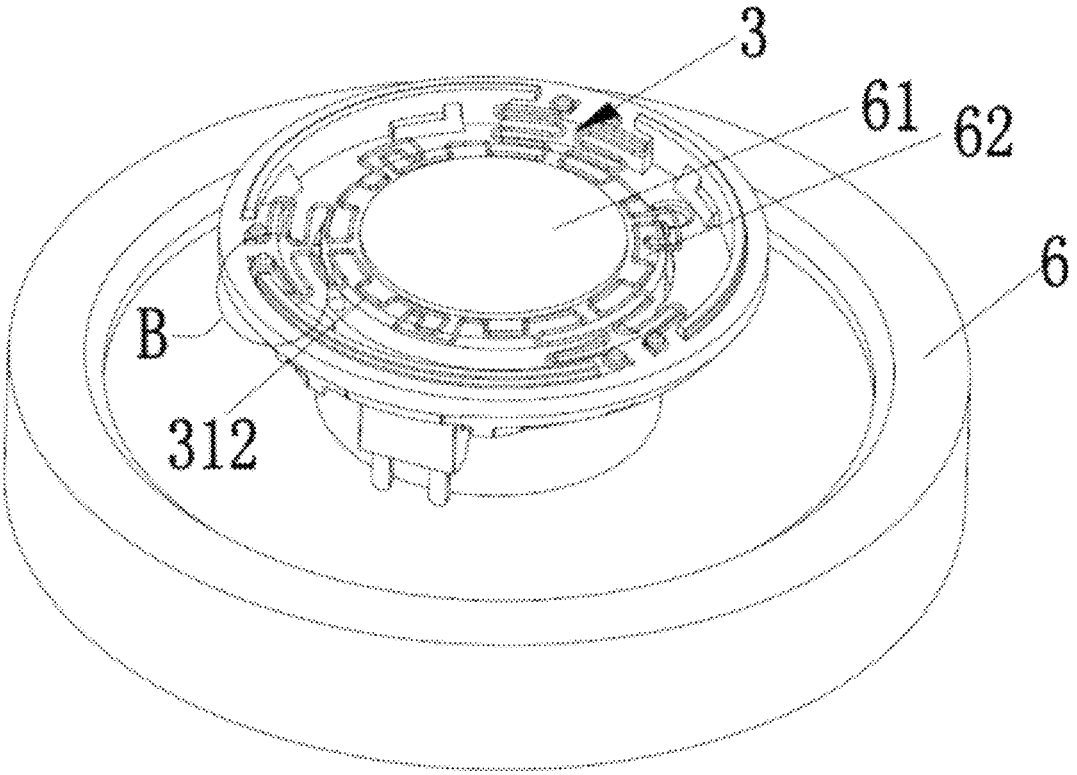
FIG. 5 is a structural schematic diagram of an assembly of the sound production device provided by the present invention.
Figure 6:
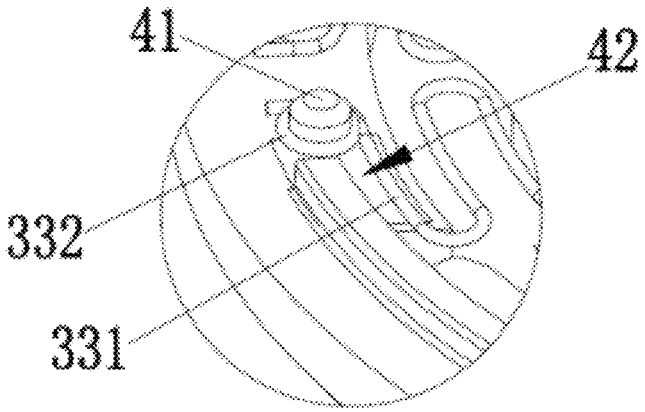
FIG. 6 is an enlarged partial schematic view of a part B of the sound production device shown in FIG. 5.

The second connection part 33 is located at the end of the deformation part 32 far away from the first connection part 31, and the second connection part 33 is used for fixedly combining with the housing 4. The system stabilization component of the traditional structure is usually a sheet structure, which is equipped with a bonding surface with housing, a face-to-face combination with the housing, and the system stabilization component and housing can usually be fixed and combined into a whole by bonding. For the system stabilization component 3 of the line-like structure of the present application, the second connection part 33 is also of a line-like structure, and the system stabilization component 3 is difficult to combine with the housing 4 in a traditional fixed way. In this embodiment, a location column 41 protruding from the housing 4 is provided on the side of the system stabilization component 3 to which the housing 4 is combined. As shown in FIG. 3, FIG. 5 and FIG. 6 together, the end of the second connection part 33 is wound on the location column 41, specifically, on the side wall of the location column 41, which may have a smooth structure, or a groove may be provided on the side wall of the location column 41 corresponding to a winding position of the second connection part 33, which is beneficial to the firm bonding of the second connection part 33 and the location column 41. The second connection part 33 of the present embodiment includes two parts including a second fixation part 332 which is wound and fixed to the location column 41 and a first fixation part 331 which is electrically connected to the pad 42 on the housing 4. The first fixation part 331 is located at one end of the deformation part 32 near the housing 4, and the first fixation part 331 is fixedly combined with the pad 42 by welding or applying the conductive adhesive, so that the system stabilization component 3 made of metal is electrically connected with an external circuit through the pad 42, thereby achieving the electrical connection between the voice coil 2 and the external circuit. The combination of the first fixation part 331 and the pad 42 can make the system stabilization component 3 and housing 4 achieve a preliminary combination, however, the bonding force between the two is obviously insufficient, and the system stabilization component 3 is prone to be separated from the housing 4. Therefore, the second fixation part 332 is further provided, and the second fixation part 332 is wound and fixed with the location column 41 on the housing 4. The second fixation part 332 is located at the end of the first fixation part 331 far away from the deformation part 32, which is a position of an end portion of the system stabilization component 3. The second fixation part 332 may be wound on the location column 41 for one turn or a plurality of turns. In order to make the second fixation part 332 and the location column 41 more firmly combined, the top end of the location column 41 in this embodiment is hot melted, and the hot melted plastic material partially or completely covers the second fixation part 332, so that the second fixation part 332 can be more firmly fixed on the housing 4.

Preferably, the first connection part 31, the deformation part 32 and the second connection part 33 are all located on the same plane, and that the first connection part 31, the deformation part 32 and the second connection part 33 are continuous, made by winding a metal wire, all extend in the same plane to form the required shapes. The structure that the line-like structure system stabilization components 3 located in the same plane can further reduce the ability of the structure of the system stabilization component 3 to deform in the horizontal direction (that is, the direction perpendicular to the vibration direction of the voice coil 2) and further reduce the polarization of the voice coil in the horizontal direction.

The voice coil 2 of this embodiment has a circular structure, three independent system stabilization components 3 are provided, wherein the three system stabilization component 3 have the same structure, of course, there are certain errors in size and structure, and the three system stabilization component 3 are uniformly disposed along the circumference of the voice coil 2, which is beneficial to ensure that the voice coil 2 receives uniform supporting force and has the best anti-polarization effect. Certainly, the number of the system stabilization component 3 is not limited to 3, but can also be 2, 4 or other numbers, but two independent circuits need to be formed for the two voice coil wires to be electrically connected respectively, and they need to be evenly distributed along the circumference. For the voice coil with a non-circular structure, the specific structure needs to be set according to the structure of the voice coil, but two independent conductive circuits need to be formed, and it is preferred that the system stabilization components are disposed symmetrically. In this embodiment, any system stabilization component 3 has a substantially symmetrical structure with respect to its own central axis L, the third bonding zone 313 is located at the central position, and the third bonding zone 313 has an asymmetrical structure with respect to its central axis L. The second bonding zones 312 are respectively disposed on both sides of the third bonding zone 313, and the two second bonding zones 312 have the same structure and a same spacing from the third bonding zone 313. Two deformation parts 32 are respectively disposed on both sides of the two second bonding zones 312, and the two deformation parts 32 have the same structure and are separated from the corresponding second bonding zones 312 by the same distance. The two deformation parts 32 are provided with the second connection part 33 at end portions thereof. The deformation parts 32 of the adjacent system stabilization components 3 are disposed opposite to each other, since the system stabilization components 3 have the same structure, bending directions of the U-bends of the two deformation parts 32 disposed opposite to each other are opposite, and the radial width of the U-bends can be set according to the specific requirements of the sound production device for amplitude. The larger the radial width of the U-bends, the greater its deformation displacement in the vibration direction for sound production.

Preferably, a material of system stabilization component 3 is a non-magnetic material, which can avoid the interference of the system stabilization component 3 on the magnetic circuit system. The system stabilization component 3 of this embodiment is phosphor bronze or beryllium copper, and these two materials have moderate rigidity and are suitable for forming a line-like system stabilization component.

The sound production device of this embodiment is a miniature sound production device, which is mainly used in earphones or portable electronic devices. The system stabilization component 3 of the line-like structure preferably adopts metal wires with a circular cross section, and the wires with the circular cross section are prone to deformation, which is convenient to follow the voice coil 2 to vibrate in the vibration direction. For this kind of miniature sound production device, a wire diameter of the system stabilization component 3 is in a numerical range of 0.08 mm-0.15 mm, and the metal wire within this range is beneficial to the deformation of the system stabilization component 3 in a Z axis direction while having enough supporting force in the horizontal direction to prevent the polarization of the voice coil 2 in the horizontal direction. With the line-like system stabilization component 3 of the present invention, when the wire diameter is within the numerical range of 0.08 mm-0.15 mm, the system stabilization component 3 can have enough supporting force to prevent the voice coil 2 from being polarized horizontally, while the traditional system stabilization component of the sheet structure has an elastic arm (deformable) with a width of greater than 0.4 mm in the horizontal direction before it has enough supporting force to prevent the polarization in the horizontal direction. Therefore, under the condition that the same supporting force is needed, because the wire diameter of the system stabilization component of the present invention is significantly reduced, thus the deformation part 32 which can undergo greater deformation displacement can be formed in the limited space of the miniature sound production device. In particular, due to the thinner wires of the system stabilization component 3, the number of the U-bends of the deformation part 32 and/or the radial width of U-bend can be increased, while a width of the elastic arm of the traditional system stabilization component is larger, and the number and radial width of the U-bends are obviously restricted by space, so its deformation displacement in the vibration direction of the voice coil is limited. When the amplitude of the voice coil is large, it will pull voice coil in the opposite direction, hindering the vibration of the voice coil and affecting acoustic performance. As an improvement, the system stabilization component of the traditional structure also has a solution to reduce the width of the elastic arm in the horizontal direction, so as to obtain the larger deformation displacement in the vibration direction of the voice coil direction, but reducing the width in the horizontal direction will also reduce its supporting force to the voice coil in the horizontal direction, and the anti-polarization effect is poor. Therefore, in the sound production device with a large amplitude, it is difficult for the traditional system stabilization component to give attention to both large deformation displacement in the vibration direction and good anti-polarization effect in the horizontal direction.

For large loudspeakers such as car speakers, due to the large size and weight of the voice coil, the wire diameter of the system stabilization component can fall within the numerical range of 0.2 mm-0.5 mm, and the metal wire having a diameter within this numerical range can meet the system stabilization component requirements of the large loudspeaker.

The present embodiment is described by using the circular sound production device as an example, in which the voice coil 2 is also circular, and the structure and shape of the system stabilization component 3 are disposed in accordance with the shape of the circular voice coil 2. It should be noted that the sound production device is not limited to this circular structure, but can also be in other common shapes such as rectangular or runway type, and the shape of the voice coil can also be rectangular or runway type. A damper of line-like structure can be applied to the voice coil of this shape after some adjustments based on the present invention.

As shown in FIGS. 1-6 together, due to the use of this novel system stabilization component of the line-like structure, the way of combining the system stabilization component 3 with the housing 4, and the way of combining the system stabilization component 3 with the voice coil 2 are changed from the prior art, and based on the above changes, the present invention provides an assembly process for this novel sound production device, including:

lifting the system stabilization component 3 by a jig 6, after the system stabilization component 3 and the housing 4 are fixedly connected, removing the jig 6 to place a voice coil 2 on the system stabilization component 3 at a position corresponding to the first connection part 31, applying glue to a position on the diaphragm 1 where it is combed with the voice coil 2, and then bonding to fix the system stabilization component and the voice coil 2.

The jig 6 includes a boss 61 including a top surface and a side surface located at a periphery of the top surface and a pallet 62 located at a lower end of the side surface, wherein the top surface, the side surface and the pallet 62 form a step. The three system stabilization components 3 of the present embodiment are lifted by the pallet 62 having a width greater than or equal to the width of the second bonding zone 312 and disposed around the side surface of the boss 61 to ensure that the system stabilization component 3 can be stably placed on the jig. In the assembly process, the housing 4 is also placed on the jig 6, wherein one side of the housing 4 on which the location column 41 is provided is located above, and a peripheral surface of the location column 41 is located on the same plane as the pallet, so as to facilitate the assembly of the system stabilization component 3 and the housing 4. After the second connection part 32 of the system stabilization component 3 is fixedly connected to housing 4, the jig is removed, and the voice coil 2 is placed on the system stabilization component 3 at a position corresponding to the first connection part 31. Specifically, the first fixation part 331 of the second connection part 32 is electrically connected to the pad 42 of the housing 4 by welding or applying conductive glue, and the second fixation part 332 is wound around the location column 41 of the housing 4, and then the location column 41 is hot melted so that the hot melted glue can cover on the second fixation part 332. The vibration diaphragm 1 includes a bonding part for bonding with the voice coil 2, glue is applied to the bonding part of the vibration diaphragm 1, and then the vibration diaphragm 1 is bonded and fixed with the system stabilization component 3 and the voice coil 2. Combined with FIG. 1, an adhesive layer 7 bonds the vibration diaphragm 1, the system stabilization component 3 and the voice coil 2 at the same time, and the three are bonded and fixed into a whole.

The sound production device of the present invention can be applied to earphones with high requirements on bass effect or portable electronic equipment.

While some specific embodiments of the present invention have been described in detail by way of examples, it should be understood by those skilled in the art that the above examples are for illustration only and are not intended to limit the scope of the present invention. It will be apparent to those skilled in the art that modifications to the above embodiment can be made without departing from the scope or spirit of the present invention. The scope of the present invention is limited by the appended claims.

The invention claimed is:

1. A sound production device comprising a housing and a vibration assembly, the vibration assembly comprising a vibration diaphragm and a voice coil combined and positioned at one side of the vibration diaphragm; wherein the sound production device further comprises a system stabilization component connected with the voice coil;

wherein the system stabilization component comprises a line-like structure including a wound metal wire, a first connection part connected to the voice coil, a deformation part, and a second connection part connected to the housing, wherein the system stabilizer is in a planar structure, and is located in a plane perpendicular to a vibration direction of the voice coil.

2. The sound production device of claim 1, wherein the first connection part comprises a first bonding zone and a third bonding zone; the first bonding zone being combined with the voice coil, the first bonding zone having a shape matching a shape of a portion of the voice coil to which the first bonding zone is combined; wherein the third bonding zone protrudes from the first bonding zone and is electrically connected with a lead of the voice coil; and the first bonding zone and the third bonding zone are located on the same plane.

3. The sound production device of claim 1, wherein the deformation part is formed by connecting a plurality of U-bend structures, with adjacent U-bends bending in opposite directions.

4. The sound production device of claim 1, wherein the housing is provided with a pad, and the second connection part includes a first fixation part located at one end of the deformation part close to the housing; and the first fixation part is electrically connected with the pad.

5. The sound production device of claim 4, wherein the second connection part further includes a second fixation part, the housing is provided with a location column, and the second fixation part is wound on the location column to combine the second fixation part with the location column as a whole; and the second fixation part is located at one end of the first fixation part far away from the deformation part.

6. The sound production device of claim 5, wherein a top end of the location column is configured to be hot melted after the second fixation part is wound on the location column.

7. The sound production device of claim 1, wherein the first connection part, the deformation part and the second connection part are continuous structures formed by a wound metal wire; and the first connection part, the deformation part and the second connection part are located on the same plane.

8. The sound production device of claim 7, wherein the voice coil is of a hollow columnar structure or a flat structure; the vibration diaphragm is selected from the group consisting of a vibration diaphragm combined with an end face of a top end or a bottom end of the voice coil and adapted for the voice coil having a hollow columnar structure, or and a vibration diaphragm combined with a narrow end face of the voice coil and adapted for the voice coil having a flat structure; and wherein the first connection part is connected to an end of the voice coil close to the vibration diaphragm; or, the first connection part is connected to an end of the voice coil far away from the vibration diaphragm; or, the first connection part is connected to an intermediate position of the voice coil.

9. The sound production device of claim 8, wherein the system stabilization component is combined to one end of the voice coil proximate to the vibration diaphragm, and the vibration diaphragm, the system stabilization component and the voice coil are bonded together; and the first connection part further comprises a second bonding zone protruding from the first bonding zone, at least part of the second bonding zone being combined to the vibration diaphragm and the voice coil.

10. The sound production device of claim 7, wherein the system stabilization component is made of a non-magnetic material.

11. The sound production device of claim 7, wherein the sound production device is a miniature sound production device, the system stabilization component comprises a wound wire with a circular cross section, and a wire diameter of the system stabilization component is within a numerical range of 0.08 mm to 0.15 mm.

12. The sound production device of claim 7, wherein the sound production device is a large sound production device, the system stabilization component comprises a wound wire with a circular cross section, and a wire diameter of the system stabilization component is within a numerical range of 0.2 mm to 0.5 mm.

13. An assembling method of a sound production device comprising the system stabilization component, the vibration assembly and the housing according to claim 1, comprising:

lifting the system stabilization component by a jig, after the system stabilization component and the housing are fixedly connected, removing the jig to place a voice coil on the system stabilization component at a position corresponding to the first connection part.

14. The assembling method of the sound production device of claim 13, wherein the assembling method further comprises applying glue to the vibration diaphragm including a bonding part for bonding with the voice coil, applying glue to the bonding part of the vibration diaphragm and then bonding and fixing the vibration diaphragm, the system stabilization component and voice coil together.

15. The assembling method of the sound production device of claim 13, wherein the jig lifts the housing and the system stabilization component simultaneously so that the system stabilization component is fixedly connected with the housing.

16. The assembling method of the sound production device of claim 15, wherein the jig includes a boss including a top surface and a side surface located at a periphery of the top surface and a pallet located at a lower end of the side surface, wherein the top surface, the side surface and the pallet form a step;

the system stabilization component is lifted by the pallet and disposed around the side surface of the boss; and a width of the pallet is greater than or equal to a width of the second bonding zone.

* * * * *